US005346419A

United States Patent [19]

Kaiser

[11] Patent Number: 5,346,419

[45] Date of Patent: Sep. 13, 1994

[54] BUOYANCY COMPENSATOR DEVICE WITH BACKPACK AND ADJUSTABLE HARNESS

[75] Inventor: Karl Kaiser, Long Beach, Calif.

[73] Assignee: International Divers Inc., La Mirada, Calif.

[21] Appl. No.: 60,624

[22] Filed: May 14, 1993

[51] Int. Cl.[5] ..... B63C 9/105

[52] U.S. Cl. ..... 441/96; 405/186; 441/111; 114/315

[58] Field of Search ..... 441/108, 106, 111, 116, 441/118, 96; 114/315; 405/186

[56] References Cited

U.S. PATENT DOCUMENTS

| | | | |
|---|---|---|---|
| 4,137,585 | 2/1979 | Wright | 128/202.14 X |
| 4,660,751 | 4/1987 | Von Dewitz | 224/210 |
| 4,778,307 | 10/1988 | Faulconer | 405/186 |
| 4,779,554 | 10/1988 | Courtney | 114/315 |
| 4,860,936 | 8/1989 | Lowe | 224/210 |
| 4,913,589 | 4/1990 | Faulconer | 405/186 |
| 4,990,115 | 2/1991 | Vorhauer | 441/111 |
| 5,004,135 | 4/1991 | Dufournet | 224/210 |
| 5,011,334 | 4/1991 | Vorhauer | 405/186 |
| 5,020,941 | 6/1991 | Bolin | 405/186 |
| 5,046,894 | 9/1991 | Bergstrom | 405/186 |

*Primary Examiner*—Jesus D. Sotelo

*Attorney, Agent, or Firm*—Shlesinger Arkwright & Garvey

[57] ABSTRACT

A buoyancy compensator device having a pair of tank encircling straps for connection of the backpack to a compressed air tank, inflation hoses for receiving air from a tank and inflating the buoyancy compensator device and valves for releasing air from the buoyancy compensator including selectively operational valves and automatic over-inflation air releasing valves. The buoyancy compensator includes a backpack portion for supporting the tank and a harness system for attaching the backpack and buoyancy compensator to a wearer. The harness system includes adjustable shoulder straps and adjustable waist straps including a cumber bun for comfortably securing the buoyancy compensator around a wearer's torso.

13 Claims, 9 Drawing Sheets

BUOYANCY COMPENSATOR DEVICE WITH BACKPACK AND ADJUSTABLE HARNESS

FIELD OF THE INVENTION

This invention relates to buoyancy compensator devices and more particularly to the backpack and harness structure for supporting a tank of compressed air upon the back of a wearer and for maintaining a secure fit underwater.

BACKGROUND OF THE INVENTION

A buoyancy compensator is used by a scuba diver to adjust his buoyancy during a dive. A scuba diver, especially one wearing a neoprene wetsuit is very buoyant at the surface of the water. In fact, lead weights are worn by scuba divers in order to assist them in descending from the surface. However, as a diver descends, air trapped within the neoprene suit tends to compress and reduce the diver's water displacement, making the diver less buoyant, whereas the lead weights continue their pull on the diver towards the bottom. In order to offset this natural condition of negative buoyancy, a buoyancy compensator is worn. As the diver descends, air is added to the air chamber in the buoyancy compensator to increase water displacement in order to maintain a neutral buoyancy at any level the diver prefers. As the diver ascends, air is released from the buoyancy compensator in order to prevent the diver from rising too quickly to the surface as the air trapped in his wetsuit expands.

Usually in combination with the buoyancy compensator, a backpack and harness system is used to connect the buoyancy compensator to a compressed air tank as well as to the diver. A buoyancy compensator includes an air chamber which may be a bladder formed of airtight material with an outer casing of flexible material or the buoyancy compensator may be formed of airtight material itself and eliminates any need for a separate bladder. The buoyancy compensator is usually directly connected to a compressed air tank so that the bladder can be power inflated at the push of a button. As noted in U.S. Pat. No. 4,137,585, buoyancy compensators have evolved from inflatable life jacket types to a modern style which will maintain a low profile for reduced drag underwater and air chambers on the front of the diver have been eliminated to leave the shoulder and chest area open for freedom of movement. The new design disclosed herein takes this feature one step further by using a harness to support the tank and eliminate tank support stress on the air pocket portions of the buoyancy compensator.

A prior design is shown for example in U.S. Pat. No. 4,778,307 and inherently precludes a snug suspension system since portions of the shoulder straps inflate. The inflation and deflation of portions of the shoulder straps causes a constant length change between the inflated and deflated configurations, thereby preventing a snug fit. A close fitting support harness provides a superior fit, enabling better balance for the diver in and out of the water.

In view of the foregoing, it can be seen that there is a need for a new buoyancy compensator having an improved backpack and harness system, the details of which will be described below.

OBJECTS AND SUMMARY OF THE INVENTION

One of the most important objects of the invention is to provide an improved harness and backpack system for a buoyancy compensator.

Another object of the invention is to provide a buoyancy compensator having an adjustable harness for permitting adjustment to a wearer's particular torso configuration.

Another object of the invention is to provide removable pockets and shoulder straps for repair or replacement to provide custom color choices for the wearer.

Yet another object of the invention is to provide a harness system which is unaffected by the inflation and deflation of air chambers within the buoyancy compensator.

Still another object of the invention is to provide a sliding track to allow vertical adjustment of shoulder strap connection locations.

Yet another object of the invention is to provide a shoulder strap configuration such that two vertically spaced connection locations are used, both being behind the wearer when the buoyancy compensator worn.

Still another object of the invention is to provide an opening through the backpack portion of the buoyancy compensator to allow passage of a tank engaging strap so that the tank may be directly engaged by the buoyancy compensator back pad.

Still another object of the invention is to provide tank engaging straps having friction enhancing materials therein for preventing slippage of an air tank through the straps.

Yet another object of the invention is to provide an inflation device for inflating air chambers within the buoyancy compensator using either oral or power inflation.

Yet another object of the invention is provide a back pad which is supported by the shoulder straps when the buoyancy compensator is worn and is removable from the buoyancy compensator.

Still another object of the invention is to make a back pad of highly porous open cell foam to minimize buoyancy of the buoyancy compensator and effect quick draining of the pad.

In summary, this invention is directed to a buoyancy compensator device including a body portion having an inside wall and an outside wall with the backpack portion including a securing band extending from the outside and adapted for securing an air tank to the backpack. The backpack has a harness attached thereto for securing the backpack to a wearer. The harness includes a torso band and a pair of shoulder straps and each of the shoulder straps has a first connection location and a second connection location wherein the first location is spaced from the second location on the inside wall of the backpack. The buoyancy compensator also includes a track having a base wall securely connected to the backpack and a slider mechanism for allowing sliding of the first connection location of the shoulder straps to be moved vertically relative to the wearer. The back pad is removably attached to the backpack and the base of the backpack includes an opening therethrough for receipt of a tank engaging strap which is connected to the back pad. The harness system and backpack is designed to promote a secure attachment to a wearer and to a tank to create a comfortable buoyancy compensation device with improved function over prior devices.

DETAILED DESCRIPTION OF THE INVENTION

Figure 1:
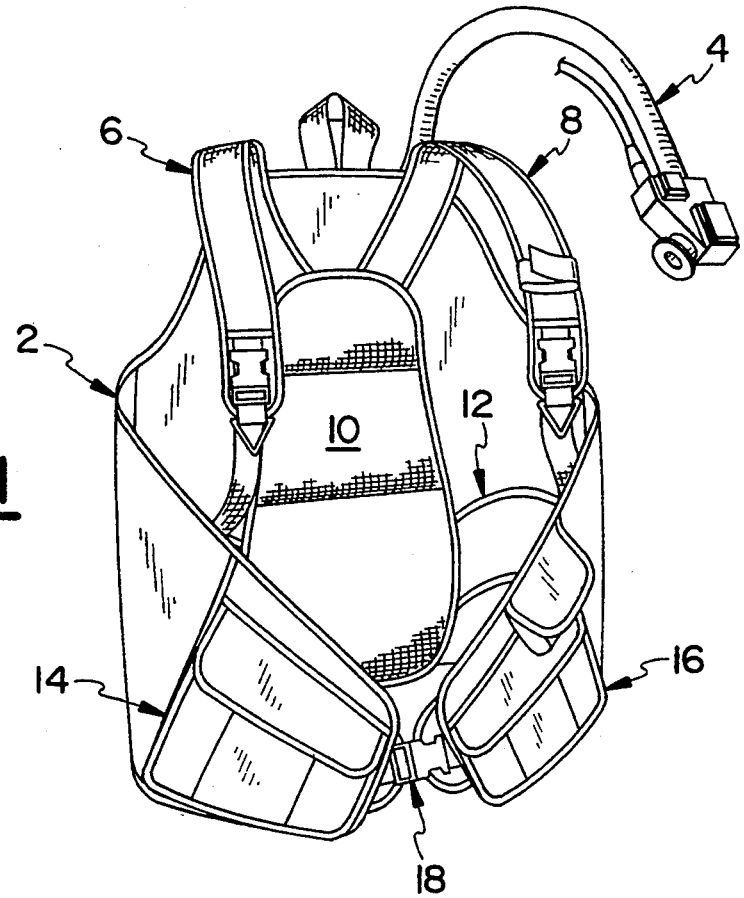
FIG. 1 is a front perspective view of the buoyancy compensator device of the present invention.

A buoyancy compensator is shown in FIG. 1 having a body 2, which includes an inflator mechanism 4, shoulder straps 6 and 8, a back pad 10, a torso band 12, a pair of front pockets 14 and 16 and a releasable front connection strap 18. The body 2 is preferably a single bag design made of 420 denier nylon coated with polyurethane.

Figure 2:
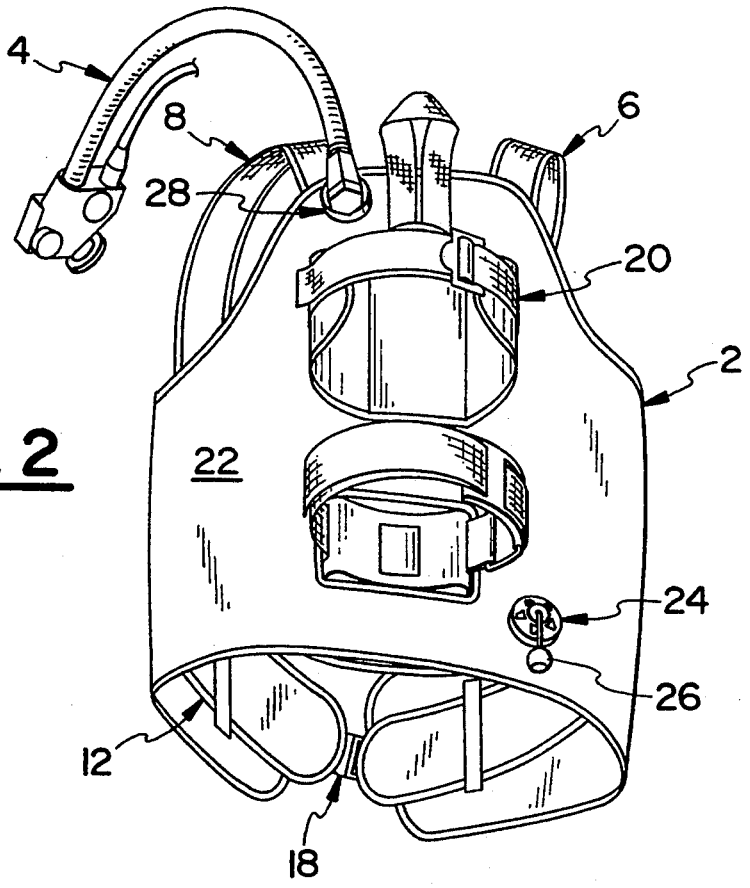
FIG. 2 is a perspective view of the back side of the buoyancy compensator device of FIG. 1.

FIG. 2 is a rear view of the buoyancy compensator 2 of FIG. 1. It shows a tank strap 20 connected to the outside wall 22 of the body of the buoyancy compensator 2.

Also shown in FIG. 2 is a combination dump valve/over-inflation valve 24 of conventional construction including a knob 26 for manual dumping of air out of the body 2. The location of the dump valve/over inflation valve 24 is advantageous in that air may be easily dumped from the buoyancy compensator 2 when the diver is inverted in the water. A second over inflation valve 28 is incorporated at the connection of the inflator mechanism 4 with the outside wall 22.

Figure 3:
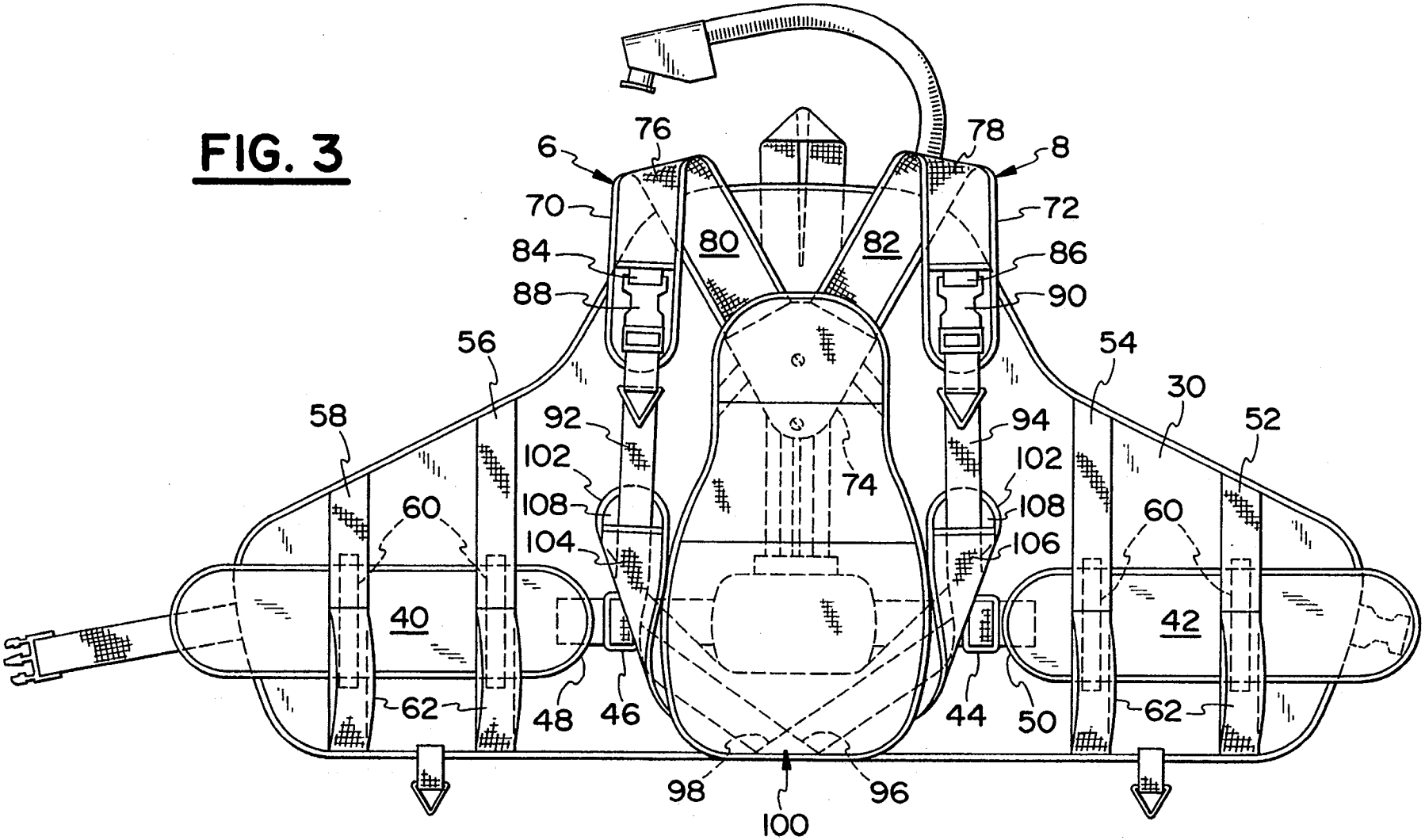
FIG. 3 is a plan view showing the inside wall of the buoyancy compensator device of FIG. 1.

In FIG. 3 the buoyancy compensator body 2 is laid open flat to reveal the inside wall 30 and reveal the harness structure. The use of the large torso band 12 is generally conventional in the buoyancy compensator field, but an additional advantageous feature of the present invention is that torso band 12 is formed of a pair of enlarged band portions which have cooperating hook and loop fastener material portions 32 and 34 on complimentary surfaces so that the band 12 can be secured about the diver. A particularly advantageous feature of the torso band 12 is the adjustable elastic connection bands 44 and 46 which connect to ends 48 and 50 of enlarged band portions 40 and 42, respectively. Each of adjustable elastic bands 44 and 46 are securely fastened to the inside wall 30 of buoyancy compensator body 2.

Torso band 12 is held in a relative vertical relationship with respect to buoyancy compensator body 2 by a plurality of, preferably four, vertically extending retaining straps 52, 54, 56 and 58. Four vertical restraining straps are preferred but more or less may be used as required. Each of the restraining straps 52, 54, 56 and 58 preferably includes a pair of sleeve forming loops 60 and 62 providing a vertical restraint on the torso band 12. Sleeve forming loops 60 are higher than sleeve forming loops 62 and this permits an optional torso band location. Slimmer individuals generally prefer the higher torso band placement whereas individuals of larger girths generally prefer the lower torso band location provided by loops 62.

While torso band 12 secures the buoyancy compensator body 2 about the torso of a diver, shoulder straps 6 and 8 secure the buoyancy compensator body 2 about the shoulders of the diver and are of particular importance in supporting the load of the compressed air tank (not shown) and the buoyancy compensator body 2 itself when the diver is out of the water. The shoulder strap harness includes upper bands 70 and 72 connected together at a central connection device 74. Each of the upper portions 70 and 72 of the shoulder straps 6 and 8, respectively are formed of a nylon material on the top side 76, and 78, respectively. The under sides 80 and 82 of upper portions 70 and 72 of straps 6 and 8, respectively, preferably include a layer of foam such as neoprene or an open cell quick draining foam such as that used in the back pad 10 to provide a cushioned surface against the shoulders of the diver. Between the top surfaces 76 and 78 and their respective under side layers 80 and 82 extends sturdy nylon webbing 84 and 86 for each strap 6 and 8 respectively, extending from the central connecting device 74 to respective buckles 88 and 90. Buckles 88 and 90 are preferably of the quick release type and preferably formed of suitable plastic material which is resistant to corrosion caused by salt water. Each of the buckles 88 and 90 includes a strap connection portion which allows vertical adjustment of each of the straps 92 and 94 connected to each of their respective buckles 88 and 90. Straps 92 and 94 extend from buckles 88 and 90 respectively and are secured at their ends 96 and 98, respectively at base 100 of buoyancy compensator body 2. Straps 92 and 94 are partially encased in U-shaped sleeve 102. Sleeve 102 includes a pair of exterior, preferably nylon, sleeve forming portions 104 and 106. Inner sleeve forming portion 108 of sleeve 102 is preferably one continuous portion and includes suitable padding therein to distribute the bearing load of the straps 92 and 94.

Figure 4:
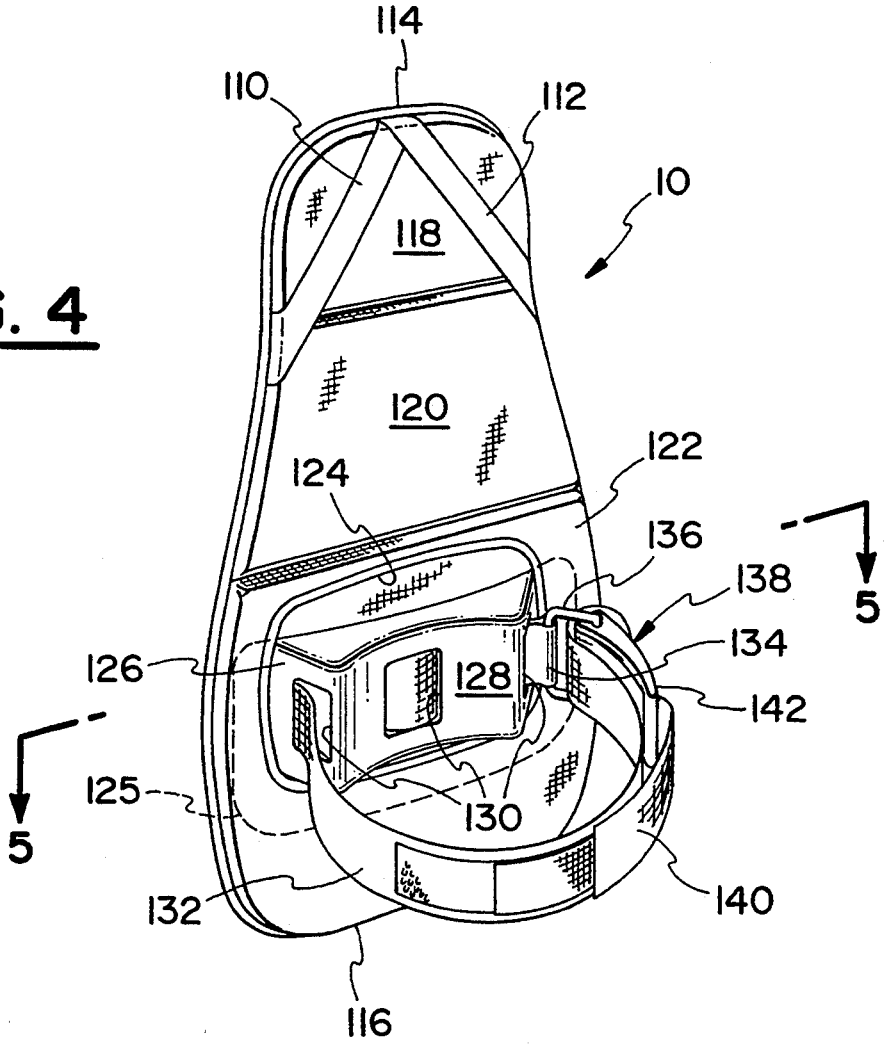
FIG. 4 is a perspective view of the rear side of the back pad.

The back pad 10 is centrally located on the inside surface 30 of the buoyancy compensator body 2 and will be further described with respect to FIG. 4. Back pad 10 is constructed of a highly porous resilient foam material, preferably reticulated open cell foam of ether based urethane. The material is non-buoyant. The back pad includes preferably a pair of suspension loops 110 and 112 as shown in FIG. 3. As shown in FIG. 3, upper portion 70 passes through loop 112 and upper portion 72 passes through loop 110 so that loops 110 and 112 suspend the back pad 10 from the central connecting device 74. Back pad 10 is formed as a pear shape being thinner at the top 114 and of larger width at the bottom 116. Back pad 10 preferably is formed of three stacked sections 118, 120 and 122. Section 122 which includes the base portion 116 also includes an opening 124 therein for receipt of a connecting flange 125 of a substantially rigid preferably polyethylene tank seat 126. Tank seat 126 includes an arcuately shaped wall 128 which is formed to the shape of a compressed air tank (not shown) and includes openings therein 130 for receipt of a tank engaging strap 132. A first end 134 of tank engaging strap 132 engages a preferably stainless steel loop 136 of buckle 138 and is fixedly secured thereto. Opposite end 140 of tank engaging strap 132 is threaded through a camming portion 142 of buckle 138 as will be further described with respect to FIG. 5 which is a cross-section of back pad 10 of FIG. 4.

Figure 5:
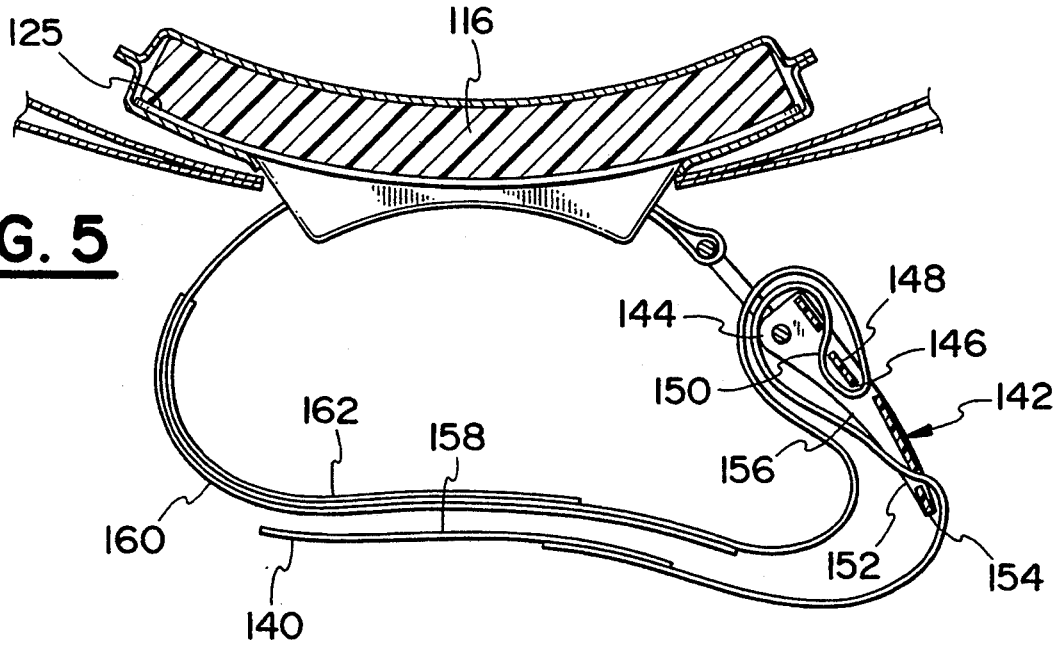
FIG. 5 is a top sectional view of the back pad and tank strap of FIG. 4.

As can be seen with respect to FIG. 5, end 140 of tank strap 132 extends around camming edge 144 and is looped through a first opening 146 around a central bar 148 and through a second opening 150 and strap 132 is brought back around camming edge 144 and then extends through the third opening 152 of the camming portion 142 past leading edge 154 and back to overlie itself. Camming portion 142 includes a pair of arcuate edges 156 which conform with the circumference of a compressed air tank.

Strap 132 includes a pair of mating hook and loop fastener surfaces thereon 158 and 160 which are complimentary for attaching the end 140 on to strap 132 for added security. Strap 132 also includes a band of friction enhancing material, preferably rubber, attached thereto to prevent tank slippage through the loop formed by strap 132.

Figures 6, 7:
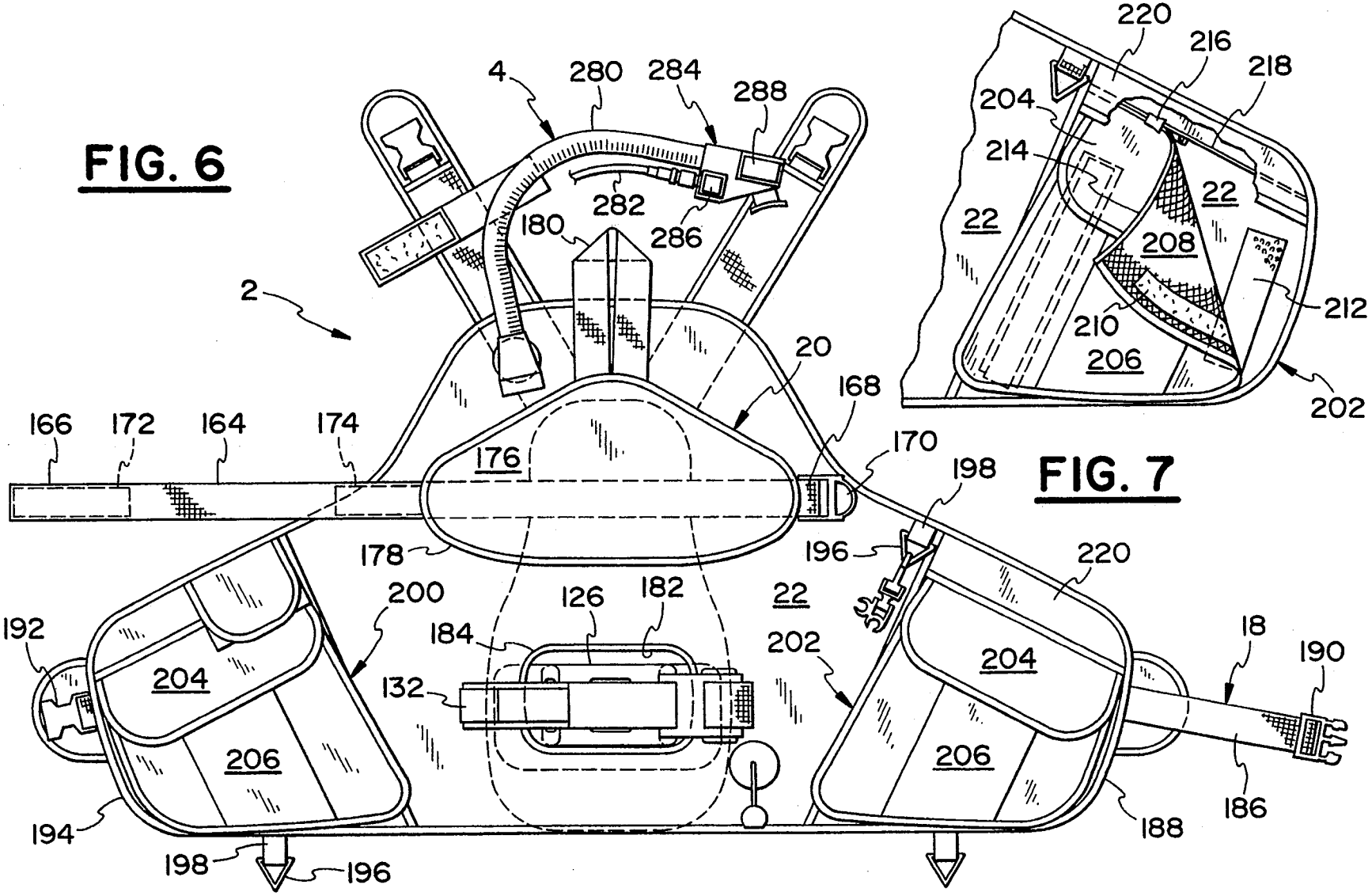
FIG. 6 is a plan view showing the outside of the buoyancy compensator device of FIG. 1.
FIG. 7 is a sectional view of the pocket of the buoyancy compensator shown in FIG. 6 with portions broken away to reveal the zipper and attachment mechanism.

FIG. 6 is an illustration showing the exterior wall 22. Attached to the exterior wall 22 as previously noted is a tank strap 20 which includes an elongated tank encircling strap 164 having a first end 166 and a second end 168. End 168 includes a buckle 170 attached thereto so that when free end 166 is passed and looped through buckle 170 a tank encircling loop is formed and the hook and loop fastener material 172 engages the hook and loop fastener material 174 on the surface of strap 164. A tank engaging sleeve 176 is secured to strap 164 (preferably by sewing) and includes of soft polyurethane layer sewn to an outer nylon shell. The soft polyurethane provides a friction enhancing surface for preventing slippage of a compressed air tank held within the strap 20. Sleeve forming portion 176 is preferably about 15 inches long at its widest point and about 8 inches high at it widest point, preferably. A nylon edging 178 encircles sleeve 176.

A lifting strap 180 is secured to exterior wall 22 of buoyancy compensator body 2 at the attachment points of sleeve 176.

Buoyancy compensator body 2 includes an opening 182 extending therethrough which is centrally located and spaced directly beneath sleeve 176. Opening 182 is preferably surrounded by edging 184 to prevent fraying of the nylon material and to provide a secure engagement between outer wall 22 and inside wall 23. Tank seat 126 and tank engaging strap 132 both protrude outwardly through opening 182 when a back pad 10 is secured in its operational position. When thus assembled, tank engaging strap 132 and tank engaging strap 164 and sleeve 176 can all securely engage the compressed air tank.

Connection strap 18 includes a band 186 extending from a first side 188 of buoyancy compensator body 2 and having a buckle portion 190 at one end thereof for connection to other buckle portion 192 which is joined to opposite edge 194 of buoyancy compensator body 2. Strap 18 includes the flexible band 186 so that when the buoyancy compensator is inflated and the exterior and interior walls 22 and 30 separate, elastic band 186 can accommodate the adjustment.

Attachment rings 196 for attaching other diving accessories such as hose holder 197 may be attached at various locations on the buoyancy compensator body 2 by flexible straps 198.

Pockets 200 and 202 are preferably removably attached to exterior 22 by a combination of attachment devices as will be described in detail with reference to FIG. 7. Each pocket includes a closure flap 204 and an exterior pocket wall 206.

Now referring to FIG. 7 it can be seen that each pocket includes an inner wall 208 preferably constructed of quick-draining nylon mesh material. Attached to the mesh material is preferably a strip of hook and loop fastener material 210 adapted for mating to a complimentary strip 212 which is adhered to the exterior surface 22. Each pocket 200 and 202 is also secured along its top edge 214 by a slide fastener 216 to a short extending section 218 joined to the exterior surface 22 of the buoyancy compensator body 2. An additional flap 220 normally overlies the zipper to prevent it from being seen or accidentally unzipped. It should be understood that other fastening devices could be used in place of both the zipper and the hook and loop fastener material such as snaps or buttons or other conventional fastening means could be used.

Figure 8:
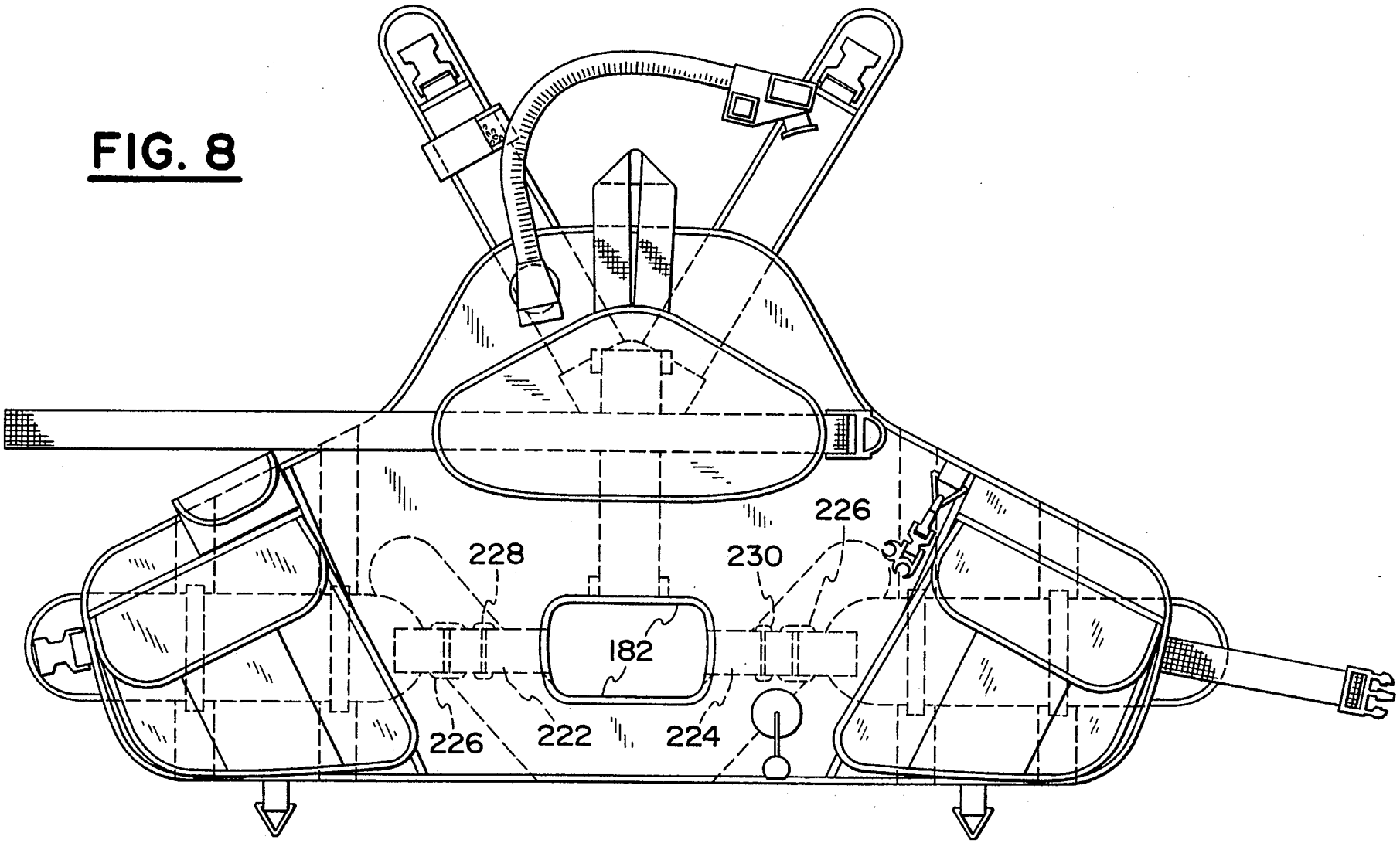
FIG. 8 is a rear view of the buoyancy compensator device of FIG. 4 with the back pad removed.

FIG. 8 is an exterior view of the buoyancy compensator body 2 of FIG. 6 with the back pad 10 removed from the interior wall 30. The back pad 10 has been removed to better illustrate opening 182 and connections 222 and 224 of straps 44 and 46 adjacent opening 182 as shown in FIG. 3 as well as FIG. 8 in hidden lines. Each of straps 44 and 46 include length adjustment buckles 226. Preferably straps 44 and 46 are constructed of elastic material to aid in adjustment and torso band 12 in connection ends 222 and 224 are preferably constructed of nylon webbing and elastic bands 44 and 46 are connected to respect straps 222 and 224 by connection loops 228 and 230, respectively.

Figure 9:
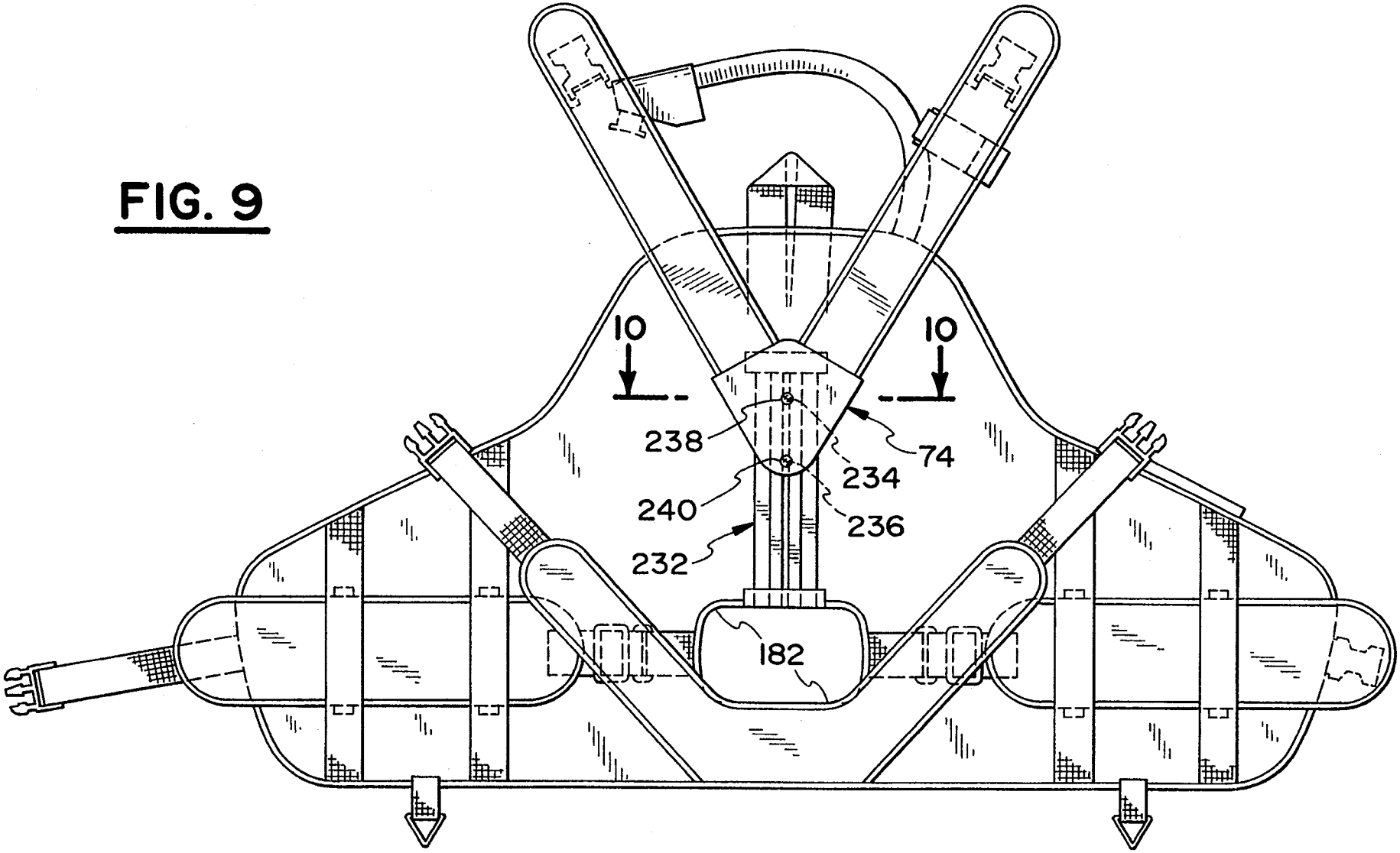
FIG. 9 is a plan view of the buoyancy compensator device shown in FIG. 3 with the back pad portion removed; and, FIG. 10 is an exploded cross-sectional view taken along lines 10—10 of FIG. 9 showing the track and shoulder strap connection.

FIG. 9 is an interior view of the buoyancy compensator with the backpack 10 removed to reveal opening 182 as well as adjustment track 232. The central connection device 74 includes a pair of openings 234 and 236 for the receipt of threaded fasteners 238 and 240. Threaded fasteners 238 and 240 extend through the central connection device 74 and engage slider 242 in the threaded openings 244 and 246, respectively.

Figure 10:
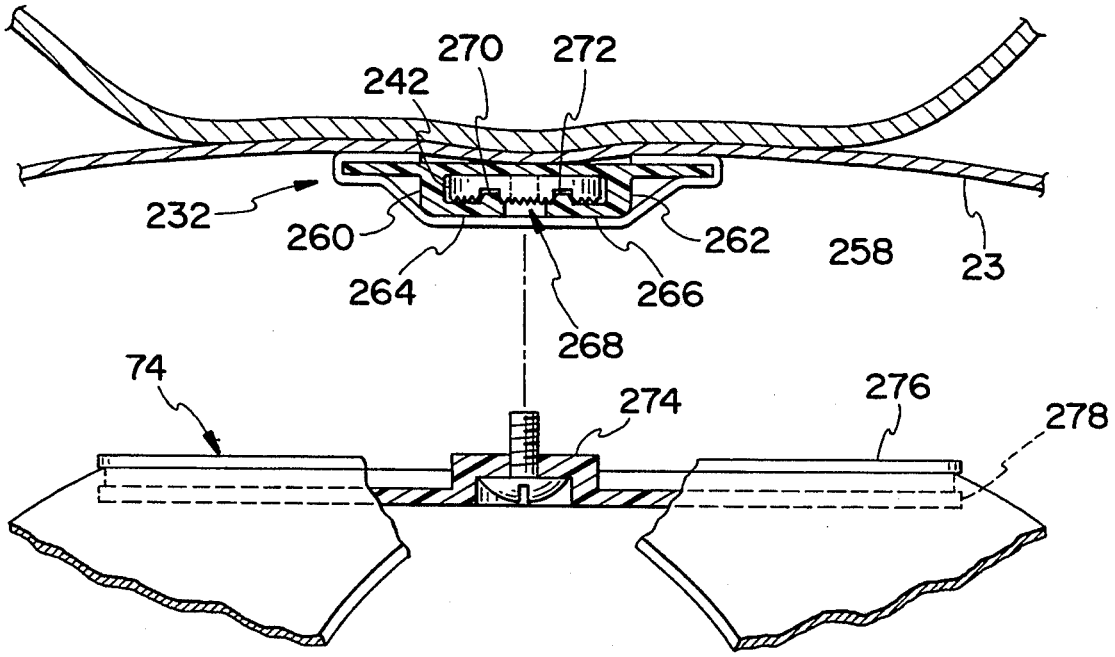
Figure 11:
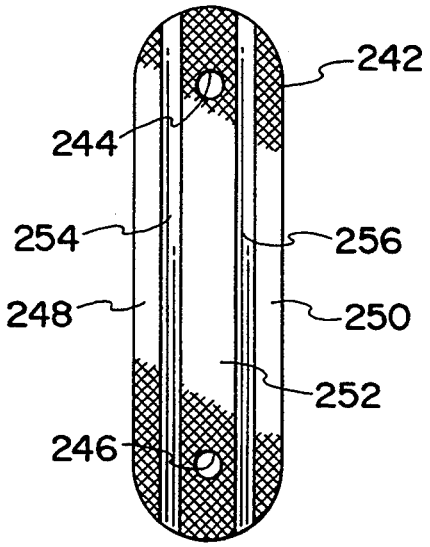
FIG. 11 is a front plan view of the slider.

As shown in FIG. 11 slider 242 preferably includes an outer raised portions 248 and 250 which have knurled surfaces. A central raised portion 252 defines a receiving area for the threaded fastener receiving openings 244 and 246 and also defines a pair of elongated channels 254 and 256. Track 232 is shown in detail in FIG. 10 which is a cross-section view taken along lines 10—10 of FIG. 9.

Now turning to FIG. 10, the track 232 is shown having a base member 258 which is securely attached to inner wall 30 of the buoyancy compensator body 2 by stitching as well as nylon retaining loops 259. Extending outwardly from the base member 258 are a pair of wall portions 260 and 262 which extend outwardly from the base member 258 in a substantially perpendicular direction about 0.25 inches. Walls 260 and 262 are preferably spaced apart about 1 inch. Connected to each of the upstanding members 260 and 262 is an inwardly extending flange 264 and 266, respectively. Flange members 264 and 266 extend substantially perpendicularly to their respective upstanding member toward each other approximately 3/16ths of an inch leaving a channel 268 approximately ⅜ths of an inch in width. A pair of channel engaging members 270 and 272 extend towards base member 258 from a respective inwardly extending portion 264 and 266 adjacent channel 268.

Track 232 receives slider 242 for adjustable vertical movement. By loosening threaded fasteners 238 and 240, slider 242 can be vertically adjusted along track 232 and then fixed in position by retightening of threaded fasteners 238 and 240 in the desired location. Slider 242 frictionally engages track 232 by sandwiching inwardly extending wall portions 264 and 266 between knurled surfaces 248 and 250 and rear wall surface 274 of central connection device 74. Both central connection portion and track 232 are preferably formed of a suitable noncorrosive material such as polyethylene. Slider 242 is preferably constructed of more rigid material and preferably aluminum. Portions of shoulder straps 70 and 72 are connected to central connection device 74 preferably by stitching and are preferably sandwiched between two layers of plastic material 276 and 278 as shown in FIG. 10. The sandwiching effect provides a strengthened connection between the upper portions of the shoulder straps 70 and 72 and central connection device 74.

The inflator mechanism 4 as best shown in FIGS. 1 and 6 includes an exhaust/oral inflation hose 280 and a power inflation hose 282. Operation end 284 includes valve actuators 286 and 288 having easily recognizable dimensions for operation by feel even when a diver is wearing gloves.

Figure 13:
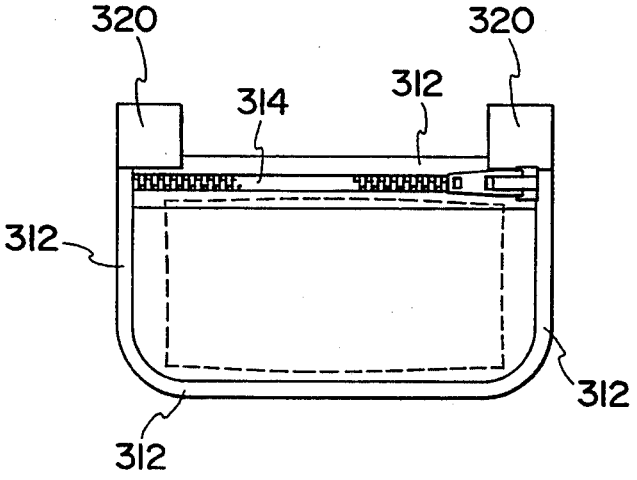
FIG. 13 shows the reverse side of a weight pocket of FIG. 12.
Figure 12:
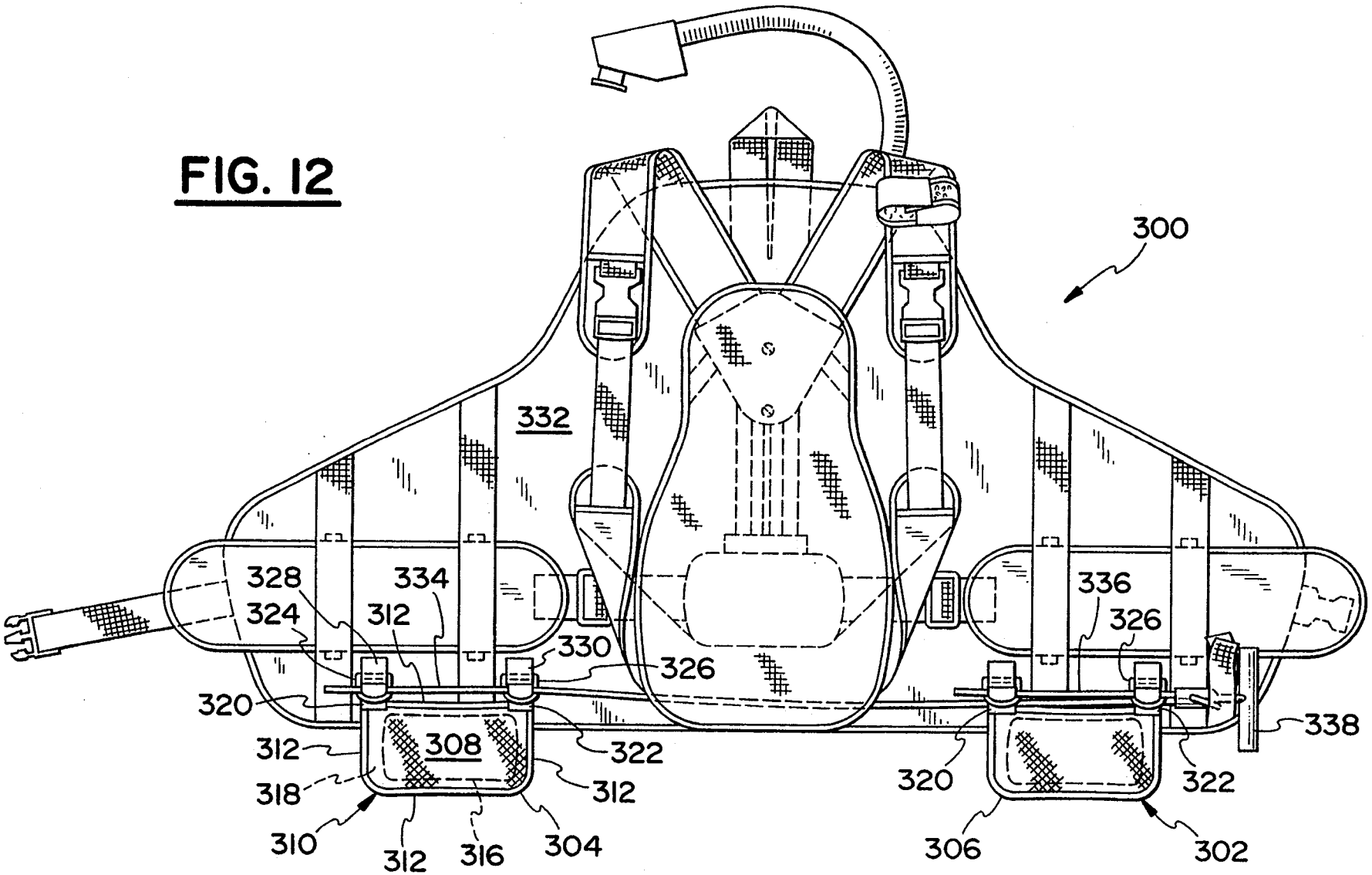
FIG. 12 is a plan view of the inside of another embodiment of a buoyancy compensator incorporating built-in weights with emergency release.

FIG. 12 illustrates another embodiment showing a buoyancy compensator body 300 having a weight system 302 incorporated therewith. The weight system 302 includes at least a pair of weight retaining chambers 304 and 306. It is important in underwater situations that the diver be balanced particularly with respect to right and left sides and back and front so that the diver will not be leaning to one side. Therefore, it is preferred that the weight system 302 include pairs of weight retaining chambers 304 and 306. The chambers themselves are preferably bags having a mesh wall 308 on one side thereof and a padded wall 310 on the other (See FIG. 13). The walls are preferably stitched and taped around all side edges 312. The mesh 308 is preferably woven nylon which is resistant to the effects of salt water and provides quick draining of the chambers 304 and 306. Each of the chambers 306 and 308 preferably includes a zipper type opening closure 314 which permits the insertion and removal of weights 316. The weights 316 are preferably bags of lead pellets weighing 2 to 5 pounds which are also encased in mesh material which will be quick draining.

As an added safety feature, inside surface 318 of outer wall 310 is preferably brightly colored whereas the weight 316 is darkly colored so that the presence of the weight in the weight retaining chambers 306 and 304 can be readily determined by sight.

Each weight retaining chamber 304 and 306 includes preferably a pair of loops 320 and 322 which allow connection to retaining rings 324 and 326 of the buoyancy compensator body 300. Retaining rings 324 and 326 are secured to the buoyancy compensator body 300 by a pair of loops 328 and 330 which are preferably stitched to interior surface 332 of the buoyancy compensator body 300.

In an emergency, the weight retaining chambers 304 and 306 can be dumped so that a diver may quickly reach the surface. Releasable connection of the weight retaining chambers 304 and 306 is accomplished by passing loops 320 and 322 through respective rings 324 and 326. Then, emergency release line 334 is passed through both loops 320 and 322 of weight retaining chamber 304 and emergency release line 336 is passed through loops 320 and 322 of weight retaining chamber 306. Emergency release lines 334 and 336 are joined to handle 338 which is held in place preferably by strips of hook and loop type fastener material 340.

The emergency release is activated by grasping handle 338 and pulling outwardly far enough so that emergency release lines 334 and 336 are pulled free of retaining loops 320 and 322 of both chambers 304 and 306. In operation, retaining line 334 would be pulled just far enough to clear loops 320 and 322 of weight retaining chamber 304 and emergency release line 336 would be pulled far enough to pass from loops 320 and 322 of bag 306. Emergency release lines 334 and 336 are preferably made of flexible plastic material that is sufficiently rigid to prevent being pulled through retaining rings 324 and 326 by the weight retaining chambers 304 and 306 when the buoyancy compensator body 300 is normally worn above water.

Figure 14:
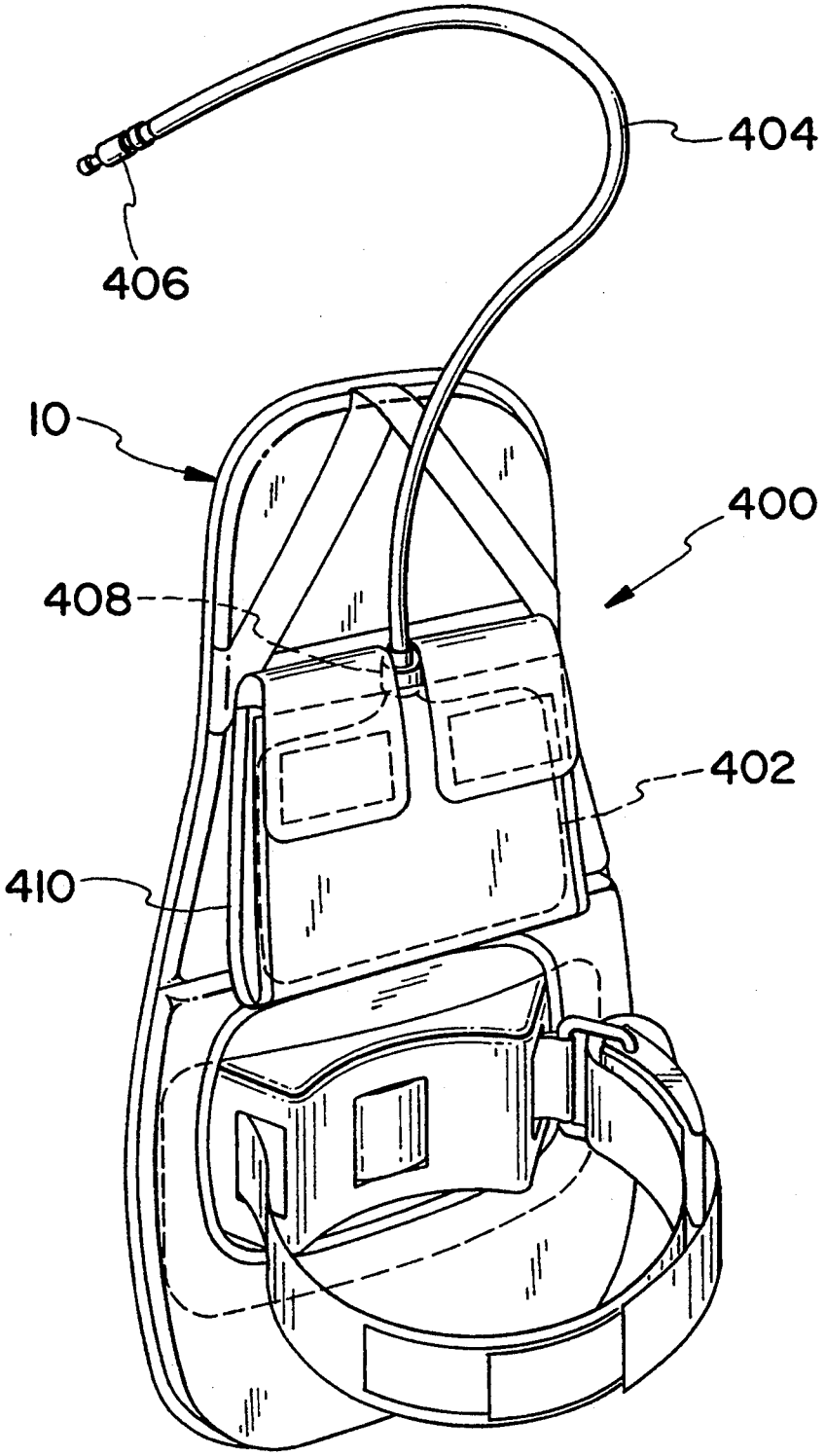
FIG. 14 is a perspective view of the back pad of FIG. 4 with a liquid holding pouch attached thereto.

Referring now to FIG. 14, a liquid refreshment device 400 for use with buoyancy compensator body 2 as shown in FIGS. 1–2, is shown having a liquid holding container 402 having a hose 404 connected thereto and extending therefrom having a sealable valve 406 at the extending end thereof which can be sealed to prevent ingress of water into the hose 404 and the container 402. Container 400 preferably includes an opening 408 for permitting insertion of liquids by filling.

Valve 406 is preferably of a one way variety commonly found for use in snorkeling vests. Container 402 is preferably carried as shown in FIG. 14 in a pocket 310 on the back pad 10. In use, pocket 410 will be the buoyancy located between back pad 10 and compensator body 2. The pocket 410 may be held in place through the use of complementary hook and loop fastener material (not shown) on both the pocket 402 itself and the back pad 10. In use, hose 406 is looped over the shoulder of the wearer so that it is accessible to a diver's mouth when the diver surfaces and can also be used when the diver is underwater should the diver do desire. The container 402 will be evacuated of air so that no buoyancy is obtained. Liquids held therein will generally be neutrally buoyant. The container 402 and hose 404 can be manufactured of preferably polyethylene or polyurethane. Pocket 410 is preferably constructed of nylon.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

I claim:

1. A buoyancy compensator device comprising:

a) a backpack portion having an inside wall and an outside wall;

b) said backpack portion includes a securing band extending from said outside wall and adapted for securing an air tank to said backpack;

c) said backpack having a harness attaches on said inside wall, said harness being adapted for securing said backpack to a wearer;

d) said harness including a pair of shoulder straps;

e) each of said shoulder straps having a first connection location and a second connection location on said inside wall wherein said first connection location is spaced from said second connection location on said inside wall of said backpack.

2. The buoyancy compensator device as set forth in claim 1, wherein:

a) each of said shoulder straps includes an upper portion and a lower portion and each of said upper portions is selectively detachably connected to one said lower portion.

3. The buoyancy compensator device as set forth in claim 1, wherein:

a) said shoulder straps include upper portions and said upper portions of said shoulder straps are secured together at said first connection location.

4. The buoyancy compensator device as set forth in claim 3, wherein:

a) a shoulder strap connection portion joins both of said shoulder straps together and to said backpack at said first connection location.

5. The buoyancy compensator device as set forth in claim 4, wherein:

a) said backpack includes a vertical track secured on said inside wall; and, b) said shoulder strap connection portion is adapted for slidable movement on said track.

6. The buoyancy compensator device as set forth in claim 5, wherein:

a) said shoulder strap connection portion includes a track engaging fastener adapted for both slidable engagement within said track and upon adjustment, secure engagement with said track.

7. The buoyancy compensator device as set forth in claim 5, wherein:

a) said track includes a base wall securely connected to said backpack;

b) a pair of spaced upstanding walls extending substantially perpendicular to said base wall; and, c) a pair of recess forming wall portions extending perpendicularly toward each other from a respective one of said upstanding walls in parallel relationship to said base wall, each of said recess forming portions having a respective guide extending perpendicularly from said recess forming portion toward said base wall and substantially parallel to said upstanding walls.

8. The buoyancy compensator device as set forth in claim 7, wherein:

a) said shoulder strap connection portion being selectively slidably engaged with said track by a track engaging fastener device;

b) said track engaging fastener device including a track engaging slider having a first side and a second side, said first side being substantially smooth for facilitating slidable engagement with said base wall of said track, said second side having a pair of channels formed therein for receiving one of said track guides and two outer portions adapted for providing a frictional engagement with an inside surface of said track; and, c) said shoulder strap connection portion including a pair of threaded fasteners for adjustably engaging said slider.

9. A buoyancy compensator device comprising:

a) a body having an inside and an outside;

b) said body includes a securing band extending from said outside and adapted for securing an air tank to said body portion;

c) said body having a harness attached thereto adapted for securing said body to a wearer;

d) said harness including a torso band and a pair of shoulder straps; and, e) said body includes a back pad located on said inside of said body, said back pad having connection devices for securing said back pad directly to said shoulder straps.

10. The buoyancy compensator device as set forth in claim 9, wherein:

a) said back pad is removably attached to said body.

11. The buoyancy compensator device as set forth in claim 9, wherein:

a) said body includes an opening therethrough.

12. The buoyancy compensator device as set forth in claim 11, wherein:

a) said back pad includes an air tank attaching device connected thereto; and, b) said air tank connecting device includes a tank band adapted for extending through said opening in said body.

13. The buoyancy compensator device as set forth in claim 9, wherein:

a) said back pad includes a pair of shoulder strap engaging loops for releasably securing said back pad to said shoulder straps.

* * * * *